United States Patent [19]

Mester

[11] Patent Number: 4,900,428

[45] Date of Patent: Feb. 13, 1990

[54] PROCESS FOR THE CATALYTIC CRACKING OF VANADIUM-CONTAINING FEEDSTOCKS

[75] Inventor: Zoltan C. Mester, Laguna Niguel, Calif.

[73] Assignee: Union Oil Company of California, Los Angeles, Calif.

[21] Appl. No.: 906,327

[22] Filed: Sep. 11, 1986

Related U.S. Application Data

[63] Continuation-in-part of Ser. No. 759,161, Jul. 26, 1985, abandoned.

[51] Int. Cl.[4] ..... C10G 11/05

[52] U.S. Cl. ..... 208/121; 208/52 CT; 208/120; 502/521

[58] Field of Search ..... 208/120, 52 CT, 113, 208/121; 502/521

[56] References Cited

U.S. PATENT DOCUMENTS

| | | | |
|---|---|---|---|
| 3,835,032 | 9/1974 | Dolbear et al. | 208/120 |
| 3,930,987 | 1/1976 | Grand | 208/120 |
| 3,957,623 | 5/1976 | McDaniel et al. | 208/120 |
| 3,994,800 | 11/1976 | Lussier et al. | 208/120 |
| 4,137,151 | 1/1979 | Csicsery | 208/120 |
| 4,299,688 | 11/1981 | Tu et al. | 208/120 |
| 4,432,890 | 2/1984 | Beck et al. | 502/62 |
| 4,440,868 | 4/1984 | Hettinger, Jr. et al. | 502/65 |
| 4,457,833 | 7/1984 | Zandona et al. | 208/120 |
| 4,480,047 | 10/1984 | Beck et al. | 502/65 |
| 4,515,683 | 5/1985 | Beck et al. | 208/113 |

*Primary Examiner*—Anthony Mc Farlane

*Attorney, Agent, or Firm*—Yale S. Finkle; Gregory F. Wirzbicki

[57] ABSTRACT

Hydrocarbon feedstocks containing relatively high levels of vanadium contaminants are converted by catalytic cracking to products of lower average molecular weight by contacting the feedstock with a catalyst comprising (1) a crystalline aluminosilicate zeolite dispersed in a matrix and (2) a vanadium passivating agent selected from the group consisting of cerium, praseodymium, neodymium, gadolinium and compounds thereof. The passivating agent is present in the catalyst in an amount greater than about 1.0 weight percent, calculated as the oxide of the vanadium passivating agent and based on the carbon-free weight of the catalyst. The passivating agent is also present in an amount such that the weight ratio of the passivating agent to any lanthanum present in the catalyst, calculated based on the respective oxides, is greater than about 1.0. The total weight of all rare earths present in the catalyst is greater than about 2.0 weight percent, calculated based on the respective rare earth oxides and on the carbon-free weight of the catalyst.

21 Claims, No Drawings

PROCESS FOR THE CATALYTIC CRACKING OF VANADIUM-CONTAINING FEEDSTOCKS

CROSS REFERENCE TO RELATED APPLICATIONS

This application is a continuation-in-part of application Ser. No. 759,161 filed in the U.S. Patent and Trademark Office on July 26, 1985, now abandoned.

BACKGROUND OF THE INVENTION

This invention relates to a catalytic cracking process and is particularly concerned with converting high molecular weight hydrocarbon feedstocks that contain substantial quantities of vanadium contaminants to lower molecular weight products utilizing a vanadium tolerant cracking catalyst.

Fluidized catalytic cracking (FCC) units are used in the petroleum industry to convert high boiling hydrocarbon feedstocks to more valuable hydrocarbon products, such as gasoline, having a lower average molecular weight and a lower average boiling point than the feedstocks from which they were derived. The conversion is normally accomplished by contacting the hydrocarbon feedstock with a moving bed of catalyst particles at temperatures ranging between about 800° F. and about 1100° F. The most typical hydrocarbon feedstock treated in FCC units comprises a heavy gas oil, but on occasions such feedstocks as light gas oils, naphthas, reduced crudes and even whole crudes are subjected to catalytic cracking to yield low boiling hydrocarbon products.

Catalytic cracking in FCC units is generally accomplished by a cyclic process involving separate zones for catalytic reaction, steam stripping, and catalyst regeneration. The hydrocarbon feedstock is blended with an appropriate amount of catalyst particles to form a mixture that is then passed to a catalytic reactor, normally referred to as a riser, wherein the mixture is subjected to a temperature between about 800° F. and about 1100° F. in order to convert the feedstock into gaseous, lower boiling hydrocarbons. After these lower boiling hydrocarbons are separated from the catalyst in a suitable separator, such as a cyclone separator, the catalyst, now deactivated by coke deposited upon its surfaces, is passed to a stripper. Here the deactivated catalyst is contacted with steam to remove entrained hydrocarbon vapors that are then combined with the vapors exiting the cyclone separator to form a mixture that is subsequently passed downstream to other facilities for further treatment. The coke-containing catalyst particles recovered from the stripper are introduced into a regenerator wherein the catalyst is reactivated by combusting the coke in the presence of an oxygen-containing gas such as air. The cyclic process is then completed by blending the reactivated catalyst particles with feedstock entering the riser of the FCC unit.

There has recently been a strong trend in the petroleum industry toward the use of higher molecular weight hydrocarbons, such as resids, as feeds to FCC units. A common problem arising from the use of such feedstocks is that they normally contain relatively high concentrations of metals, such as nickel, vanadium, iron and copper, which tend to deposit on the catalyst during cracking operations, thereby gradually reducing the activity and selectivity of the cracking catalyst. These metals are normally present in the form of organometallic compounds, such as porphyrins and asphaltenes (where the metals are coordinated to heteroatom elements). Some of the metal contaminants which deposit on the catalyst, such as nickel constituents, deleteriously affect selectivity by increasing the production of hydrogen, light gases and coke. Other metal contaminants, such as vanadium, decrease activity by destroying the zeolite portion of the catalyst. According to U.S. Pat. Nos. 4,432,890 and 4,485,184, the disclosures of which are hereby incorporated by reference, vanadium is especially detrimental to catalyst life. These patents teach that as the vanadium oxide level on the catalyst increases, the high temperatures encountered in the catalyst regenerator cause vanadium pentoxide ($V_2O_5$) to melt and begin to flow. The resultant liquid vanadium pentoxide enters the zeolite structure, irreversibly destroying the structure of the zeolite so as to form a less active amorphous material. The melting and the flowing of the vanadium pentoxide can, in some cases, also cause coalescence between catalyst particles which adversely affects fluidization properties.

Accordingly, it is an object of the present invention to provide a fluid catalytic cracking process for treating feedstocks that contain relatively high concentrations of vanadium constituents while maintaining the activity of the catalyst at a reasonable level. This and other objects of the invention will become more apparent in view of the following description of the invention.

SUMMARY OF THE INVENTION

In accordance with the invention, it has now been found that the deleterious effects of vanadium constituents on the activity of a catalytic cracking catalyst comprising a crystalline aluminosilicate zeolite having cracking activity dispersed in a matrix or binder can be substantially avoided by providing the catalyst with a passivating agent selected from the group consisting of cerium, praseodymium, neodymium, gadolinium and compounds thereof. The catalyst is provided with a sufficient amount of the passivating agent so that it is present in the catalyst in a total amount greater than about 1.0 weight percent calculated as the oxide of the passivating agent and based on the carbon-free weight of the catalyst. The weight ratio of the passivating agent to any lanthanum present in the catalyst, calculated based on the respective oxides, is greater than about 1.0 and the total weight of all rare earths present in the catalyst is greater than about 2.0 weight percent, calculated based on the respective rare earth oxides and on the carbon-free weight of the catalyst. The crystalline aluminosilicate zeolite can be any zeolite possessing catalytic cracking activity, such as X and Y zeolites. The matrix or binder is normally comprised of one or more porous, inorganic refractory oxides. The passivating agent may be deposited onto the cracking catalyst prior to use of the catalyst or during the cracking process itself.

In general, the feedstock to the catalytic cracking process in which the passivated cracking catalyst is used will contain greater than about 1.0 ppmw vanadium, normally more than about 5.0 ppmw vanadium, calculated as the metal. Typically, the feed will be an unhydrotreated oil containing more than about 70 percent components boiling above about 650° F.

DETAILED DESCRIPTION OF THE INVENTION

In accordance with this invention, catalysts comprising a crystalline aluminosilicate zeolite having cracking activity dispersed in a porous, inorganic refractory oxide matrix or binder and a passivating agent selected from the group consisting of cerium, neodymium, praseodymium, gadolinium and compounds thereof are used in a fluidized catalytic cracking process or other cyclic catalytic cracking process carried out in the substantial absence of added molecular hydrogen in which a hydrocarbon feedstock containing vanadium constituents is refined to produce low-boiling hydrocarbon products by passage through a catalytic cracking reaction zone. In general, any crystalline aluminosilicate zeolite possessing catalytic cracking activity may be used as a component of the catalyst. Examples of such zeolites include Y zeolites, ultrastable Y zeolites, X zeolites, zeolite beta, zeolite L, offretite, mordenite and zeolite omega. The most preferred zeolites are crystalline aluminosilicate Y zeolites.

U.S. Pat. No. 3,130,007, the disclosure of which is hereby incorporated by reference in its entirety, describes Y-type zeolites having an overall silica-to-alumina mole ratio between about 3.0 and about 6.0, with a typical Y zeolite having an overall silica-to-alumina mole ratio of about 5.0. It is also known that Y-type zeolites can be produced, normally by dealumination, having an overall silica-to-alumina mole ratio above about 6.0. Thus, for purposes of this invention, a Y zeolite is one having the characteristic crystal structure of a Y zeolite, as indicated by the essential X-ray powder diffraction pattern of Y zeolite, and an overall silica-to-alumina mole ratio above 3.0, and includes Y-type zeolites having an overall silica-to-alumina mole ratio above about 6.0. Both nondealuminated and dealuminated Y zeolites may be used as the zeolitic component of the catalyst of the invention. The term "dealuminated Y zeolite" as used herein refers to a Y zeolite which has been treated to remove aluminum from the framework structure of the zeolite. A dealuminated Y zeolite may have an overall silica-to-alumina mole ratio above or below 6.0. It will be understood that in converting a Y zeolite starting material to a dealuminated Y zeolite, the resulting dealuminated zeolite may not have exactly the same X-ray powder diffraction pattern for Y zeolites as is disclosed in U.S. Pat. No. 3,130,007. The d-spacings may be shifted somewhat due to a shrinkage in the unit cell size which is due to a decrease in framework aluminum content. The essential crystal structure of Y zeolite will, however, be retained so that the essential X-ray powder diffraction pattern of the dealuminated zeolite will be consistent with that of either Y zeolite itself or a Y zeolite of reduced unit cell size. Normally, the unit cell size for the dealuminated Y zeolite will be below about 24.65 Angstroms.

The stability and/or acidity of a Y zeolite, whether dealuminated or nondealuminated, used as a component of the cracking catalyst may be increased by exchanging the Y zeolite with ammonium ions, polyvalent metal cations, such as rare earth-containing cations, magnesium cations or calcium cations, or a combination of ammonium ions and polyvalent metal cations, thereby lowering the sodium content until it is less than about 0.8 weight percent, preferably less than about 0.5 weight percent and most preferably less than about 0.3 weight percent, calculated as $Na_2O$. Methods of carrying out the ion exchange are well known in the art.

The Y zeolite or other crystalline aluminosilicate zeolite component of the catalyst is combined with a porous, inorganic refractory oxide matrix or binder to form a finished catalyst prior to use. The refractory oxide component in the finished catalyst may be silica-alumina, silica, alumina, natural or synthetic clays, mixtures of one or more of these components and the like. Preferably, the inorganic refractory oxide matrix will comprise a mixture of alumina and a clay such as kaolin. A preferred finished catalyst will typically contain between about 5 weight percent and about 40 weight percent zeolite and greater than about 20 weight percent alumina. In general, the finished catalyst will contain between about 10 weight percent and about 35 weight percent zeolite, between about 10 weight percent and about 25 weight percent alumina, and between about 30 weight percent and about 60 weight percent clay.

The crystalline aluminosilicate zeolite may be combined with the porous, inorganic refractory oxide component or a precursor thereof by techniques including mixing, mulling, blending or homogenization. Examples of precursors that may be used include alumina, alumina sols, silica sols, alumina hydrogels and peptized alumina. In a preferred method of preparing the cracking catalyst, the zeolite is combined with an alumina sol or other inorganic refractory oxide component, and the resultant mixture is spray dried to produce finished catalyst particles normally ranging in size between about 40 microns and about 80 microns. If desired, however, the zeolite may be mulled or otherwise mixed with the refractory oxide component or precursor thereof, extruded and then ground into the desired particles size range. Normally, the finished catalyst will have an average bulk density between about 0.30 gram per cubic centimeter and about 0.70 gram per cubic centimeter and a pore volume between about 0.10 cubic centimeters per gram and about 0.90 cubic centimeters per gram.

As pointed out previously, the stability and/or acidity of the zeolite utilized as the cracking component of the catalyst is often increased by exchanging the zeolite with rare earth-containing cations prior to compositing the zeolite with the binder or matrix. Normally, such a rare earth ion exchange is carried out by immersing the zeolite in a solution of rare earth chlorides which is lanthanum rich and contains, in addition to lanthanum, predominantly neodymium, cerium, and praseodymium. The catalyst containing the resultant rare earth-exchanged zeolite will contain lanthanum as its major rare earth constituent. Typically, lanthanum will be present in amounts such that the weight ratio of lanthanum to cerium, praseodymium or neodymium present, calculated based on the respective oxides, will be greater than about 1.0, generally greater than about 1.5. Typically the concentration of cerium, praseodymium and neodymium present individually in the catalyst containing the rare earth-exchanged zeolite will be less than about 1.0 weight percent calculated as the oxide, generally less than about 0.7 weight percent. Cracking catalysts containing such rare earth-exchanged zeolites and other zeolites normally become poisoned and severely deactivated for cracking when the vanadium constituent concentration of the catalyst rises to above a value in the range between about 1500 ppmw and about 2500 ppmw vanadium, calculated as the metal.

It has now been found that the deleterious effects of vanadium on cracking catalysts can be substantially avoided by providing the catalyst with a passivating agent selected from the group consisting of cerium, praseodymium, neodymium, gadolinium and compounds thereof. It has been found that a catalyst containing one of these passivating agents in an amount greater than about 1.0 weight percent, calculated as the oxide of the passivating agent, and in an amount such that the weight ratio of the passivating agent to any lanthanum present in the catalyst, calculated based on the respective oxides, is greater than about 1.0, will be resistant to substantial deactivation by vanadium constituents in the catalytic cracking feedstock. Typically, the passivating agent will be present in an amount greater than about 1.5 weight percent, however, in some cases it may be desirable that the passivating agent be present in an amount greater than about 2.0 weight percent, in some cases even in an amount greater than about 3.0 weight percent. The weight ratio of the passivating agent to any lanthanum present in the catalyst, calculated based on the respective oxides, will normally be greater than about 1.5, and in some cases may be greater than about 2.0. The total weight of all rare earths present in the catalyst is typically greater than about 2.0 weight percent, calculated based on the respective rare earth oxides and on the carbon-free weight of the catalyst. The total weight, however, may be greater than about 3.0 weight percent and, in some cases, may even be greater than about 5.0 weight percent.

It has surprisingly been found that lanthanum and other rare earths such as ytterbium and holmium will not exhibit the passivating effect shown by cerium, praseodymium, neodymium and gadolinium. Thus, unlike catalysts that comprise zeolites which have been exchanged with a lanthanumrich rare earth solution to increase stability and/or acidity and therefore contain lanthanum as the major rare earth constituent, the catalyst used in the process of the invention will contain the passivating rare earth, cerium, praseodymium, neodymium or gadolinium, in an amount greater than the amount of lanthanum that may be present. Thus, the weight ratio of any lanthanum that may be present in the catalyst to the total concentration of the passivating rare earth, calculated based on the respective oxides, will be less than 1.0 instead of greater than 1.0, preferably less than about 0.7, and most preferably less than about 0.5.

The passivating rare earth may be added to the cracking catalyst, which may already contain some of the same rare earth, to form the catalyst used in the process of the invention by depositing or impregnating the passivating rare earth into the cracking catalyst prior to use of the catalyst or during the cracking process. One method of adding the passivating rare earth to the catalyst is to contact fresh catalyst with an aqueous solution containing the passivating rare earth. The solution may be sprayed onto the catalyst or the catalyst may be slurried in the aqueous solution. Any water soluble form of the passivating rare earth may be dissolved in water to form the aqueous solution. Examples of such water soluble forms include the chloride and nitrate salts of cerium, praseodymium, neodymium and gadolinium. Other water soluble forms of the passivating rare earth include sulfates, bromides, iodides, perchlorates and acetates. After the catalyst has been sprayed or slurried with the aqueous solution of the passivating rare earth, it is calcined at a temperature between about 500° F. and about 600° F. for between about 1.0 hours and about 3.0 hours.

Normally, the catalyst used in the process of the invention is prepared by impregnating a fresh catalyst with the passivating agent in the above-described manner. Another method of adding the passivating agent to the catalyst utilizes the feedstock to the FCC unit. A hydrocarbon soluble form of the passivating rare earth is dissolved in the feedstock and allowed to deposit onto the catalyst during the catalytic cracking process. Examples of hydrocarbon soluble forms of the passivating rare earth include tris (cyclopendtadienyl) praseodymium, neodymium isopropoxidechloride, and macrocyclic polyether rare earth compounds. Other methods of depositing or impregnating the rare earth passivating agent into the cracking catalyst are within the scope of the invention.

The deposition or impregnation of the passivating rare earth into the catalyst after the zeolite has been composited with the binder or matrix ensures that a large portion of the total rare earth content of the catalyst will be present in the matrix or binder. It is normally desirable to have more than about 50 weight percent of the total amount of passivating rare earth, calculated as the oxide, contained in the catalyst present in the matrix or binder, preferably more than about 70 weight percent and most preferably more than about 80 weight percent. Although the mechanism by which the added rare earth effects passivation is not known, it is believed that the added rare earth constituents deposit themselves in the matrix where they serve to interact physically or chemically with the deactivating vanadium components, thereby preventing these components from migrating into the zeolite particles that are dispersed uniformly throughout the matrix.

Although it is desirable that a major portion of the passivating rare earth constituents be in the matrix, the impregnation step in which the passivating rare earth is added to the cracking catalyst is not followed with a subsequent treatment to induce precipitation of the passivating rare earth as is disclosed in U.S. Pat. No. 4,515,683, the disclosure of which is hereby incorporated by reference in its entirety. As used herein "precipitation" refers to the reaction of the rare earth passivating agent with a compound that will cause the rare earth cations to form a water insoluble substance. Examples of such compounds include oxalic acid and hydroxides such as ammonium hydroxide. The passivating rare earth is added to the cracking catalyst used in the process of the invention by ionic deposition as opposed to the nonionic deposition taught in U.S. Pat. No. 4,515,683.

In general, conventional cracking catalysts become poisoned and ineffective for cracking when the vanadium content of the catalyst rises above a value in the range between about 1500 ppmw and about 2500 ppmw, calculated as the metal. It has been found that the passivated cracking catalyst used in the process of the invention remains an effective catalyst even though the vanadium content of the catalyst exceeds about 5000 ppmw vanadium, calculated as the metal. The effectiveness of praseodymium and gadolinium as the passivating agent appears to lessen as the concentration of vanadium on the catalyst rises above about 7500 ppmw. The effectiveness of cerium, on the other hand, appears to be much less dependent on the vanadium concentration. In general, cerium is effective as a passivating agent when the vanadium content of the catalyst ranges between about 1000 ppmw and about 10,000 ppmw, calculated as the metal, whereas praseodymium and gadolinium are effective passivating agents when the vanadium concentration is typically between about 1500 ppmw and about 7500 ppmw.

The hydrocarbon feedstocks that can be effectively treated in the process of the invention will generally include feedstocks containing relatively high concentrations of metals, at least about 70 volume percent components which boil above 650° F., and greater than about 20 volume percent constituents boiling above about 1025° F. Such feedstocks typically contain heavy bottoms material such as tars, asphalts, asphaltenes and resins in which contaminant vanadium constituents tend to accumulate. Examples of suitable feedstocks for the process of the invention include whole crudes, nondeasphalted crude oil resids, heavy gas oils boiling between about 650° F. and about 1100° F., and atmospheric and vacuum distillation bottoms containing significant amounts of material boiling above 1150° F. Suitable feedstocks not only include petroleum derived fractions but also hydrocarbon oils derived from coal, shale, tar sands, and similar hydrocarbon-containing solids. The feedstocks may contain significant quantities, normally greater than about 0.5 weight percent, typically more than about 2 weight percent and even greater than about 4 weight percent, asphaltenes and other pentane insoluble materials.

The nature and objects of the invention are further illustrated by the following examples, which are provided for illustrative purposes only and not to limit the invention as defined by the claims. The examples demonstrate that when cerium, praseodymium, neodymium or gadolinium are added to a cracking catalyst along with vanadium, the decrease in the activity of the catalyst is substantially less than the decrease observed when vanadium is added to the catalyst without adding cerium, praseodymium, neodymium or gadolinium.

EXAMPLE 1

A 150 gram sample of a fresh, commercially available catalytic cracking catalyst known as Sigma 400 is calcined at 600° C. for 2 hours. This catalyst is made by Katalistiks and is commercially sold as a high gasoline producing, relatively high metals tolerant cracking catalyst. The chemical formulation of Sigma 400 is set forth in Table 1 below.

TABLE 1

| Chemical Formulation of Fresh Commercial Catalysts | | |
|---|---|---|
| | Sigma 400 | Super DX |
| $SiO_2$, wt. % | 62.9 | 60.6 |
| $Al_2O_3$, wt. % | 33.4 | 30.6 |
| $Na_2O$, wt. % | 0.66 | 0.98 |
| Total Rare Earth Oxides, wt. % | 2.28 | 2.96 |
| $La_2O_3$ | 1.31 | 1.32 |
| $CeO_2$ | 0.36 | 0.84 |
| $Pr_6O_{11}$ | 0.15 | 0.20 |
| $Nd_2O_3$ | 0.46 | 0.60 |

A portion of the Sigma 400 sample is impregnated with vanadium by immersing the catalyst into a solution containing vanadyl naphthanate dissolved in xylene. The vanadium-containing catalyst is then dried at 150° C. for 2 hours and calcined at 550° C. for 4 hours. Portions of the vanadium-containing catalyst are impregnated with various rare earth metals by placing each portion in a aqueous solution of the desired rare earth nitrate and mixing the resultant slurry for 4 hours at 80° C. Next, each catalyst portion is dried at 150° C. for 2 hours and then calcined at 550° C. for 2 hours. The fresh catalyst, the vanadium impregnated catalyst and the catalyst portions containing both vanadium and an added rare earth are then deactivated for activity testing by treatment in 100 percent flowing steam at 1450° F. for 5 hours. The deactivated catalysts are evaluated for cracking activity by use of the standard microactivity test method (MAT). A vacuum gas oil having an API gravity of 27.3° and containing about 40 volume percent components boiling below 650° F. and about 95 volume percent components boiling below about 980° F. at atmospheric pressure is cracked in the presence of each catalyst at a temperature of 950° F. The tests are carried out at a weight hourly space velocity of 14.0 and at atmospheric pressure utilizing a catalyst-to-oil weight ratio of 3.8. The results of these tests are set forth below in Table 2.

TABLE 2

| Run No. | Rare Earth Additive | Rare Earth[a] Additive Loading (wt. %) | Total[b] Rare Earth Loading (wt. %) | Vanadium[c] Loading (ppmw) | Conversion (Vol %) | Gasoline (Vol %) |
|---|---|---|---|---|---|---|
| 1 | None added | — | 2.28 | — | 83.1 | 64.1 |
| 2 | None added | — | 2.28 | 5200 | 26.9 | 19.7 |
| 3 | Cerium | 1.85 | 3.77 | 5300 | 63.9 | 51.6 |
| 4 | Praseodymium | 1.37 | 3.50 | 5300 | 55.6 | 46.8 |
| 5 | Neodymium | 2.32 | 4.14 | 5300 | 55.0 | 45.7 |
| 6 | Gadolinium | 1.29 | 3.57 | 5600 | 40.7 | 32.5 |
| 7 | Lanthanum | 2.78 | 3.75 | 5400 | 23.1 | 16.5 |
| 8 | Ytterbium | 2.91 | 5.19 | 5300 | 22.5 | 18.1 |
| 9 | Holmium | 1.76 | 4.04 | 5400 | 28.1 | 23.7 |

[a]Represents the sum, calculated based on the oxide, of the amount of the particular rare earth additive and the amount of any of that same rare earth already present in the catalyst.
[b]Represents the sum of the amounts of all rare earths present in the catalyst calculated based on the respective oxides of the rare earths.
[c]Concentration in ppmw based on vanadium metal.

As can be seen from run 1 in Table 2, the fresh Sigma 400 catalyst containing no vanadium and no rare earth additives (i.e., rare earths in addition to those in the fresh catalyst as shown in Table 1) exhibits a high activity as indicated by an 83.1 volume percent conversion. The catalyst of run 2, which contains 5200 ppmw vanadium, on the other hand, is very inactive as indicated by a 26.9 volume percent conversion. The data for runs 3 through 6 demonstrate that the addition of cerium, praseodymium, neodymium and gadolinium to the vanadium-containing catalyst serves to passivate the deactivating effect of the vanadium as shown by volume percent conversions that are much higher than the 26.9 obtained in run 2 with the vanadium deactivated catalyst. The original activity of the fresh catalysts which contains no vanadium contaminants, however, cannot be achieved. The use of neodymium, praseodymium and cerium as the rare earth additive or passivating agent results in a doubling of the volume percent conversion over that obtained in run 2 utilizing the vanadium contaminated catalyst. Cerium seems to be the most effective additive or passivating agent as indicated by a volume percent conversion of 63.9, which is 2.4 times as great as the 26.9 volume percent conversion obtained in run 2 with the vanadium deactivated catalyst. Runs 7 through 9 in Table 2 demonstrate that lanthanum, ytterbium and holmium have no passivating effect whatsoever. The volume percent conversions obtained from these runs range from 22.5 to 28.1, values that vary little from the 26.9 volume percent conversion obtained in run 2 with the vanadium deactivated catalyst.

EXAMPLE 2

The same procedure is carried out as that described in Example 1 except that the concentration of vanadium in the vanadyl naphthanate solution is sufficient to yield vanadium loadings of about 7800 ppmw instead of about 5300 ppmw. Also, neodymium is not used as a rare earth additive. The results of these tests are set forth below in Table 3.

TABLE 3

| Run No. | Rare Earth Additive | Rare Earth[a] Additive Loading (wt. %) | Total[b] Rare Earth Loading (wt. %) | Vanadium[c] Loading (ppmw) | Conversion (Vol %) | Gasoline (Vol %) |
|---|---|---|---|---|---|---|
| 10 | None added | — | 2.28 | 7700 | 17.5 | 11.8 |
| 11 | Cerium | 1.83 | 3.75 | 7600 | 39.6 | 31.6 |
| 12 | Praseodymium | 1.19 | 3.32 | 7800 | 17.4 | 11.1 |
| 13 | Gadolinium | 2.19 | 4.47 | 8100 | 21.5 | 11.2 |
| 14 | Lanthanum | 2.46 | 3.43 | 8000 | 17.6 | 11.5 |
| 15 | Ytterbium | 3.69 | 5.97 | 7800 | 17.4 | 11.4 |
| 16 | Holmium | 1.85 | 4.13 | 7800 | 18.8 | 12.6 |

[a]Represents the sum, calculated based on the oxide, of the amount of the particular rare earth additive and the amount of any of that same rare earth already present in the catalyst.
[b]Represents the sum of the amounts of all rare earths present in the catalyst calculated based on the respective oxides of the rare earths.
[c]Concentration in ppmw based on vanadium metal.

A comparison of run 10 in Table 3 with run 2 in Table 2 indicates that the increase in vanadium loading from 5200 ppmw to 7700 ppmw decreases conversion from 26.9 volume percent to 17.5 volume percent and gasoline make from 19.7 to 11.8 volume percent. A comparison of run 11 in Table 3 with run 3 in Table 2 shows that cerium is as effective a passivating agent at vanadium loadings of about 7600 ppmw as it is at vanadium loadings of 5300 ppmw. The data for run 11 indicate that the presence of cerium increases the volume percent conversion obtained with the vanadium deactivated catalyst in run 10 from 17.5 to 39.6, a 2.3 fold increase. Comparisons of runs 12 and 13 in Table 3 with runs 4 and 6 in Table 2, demonstrate that praseodymium and gadolinium are not effective passivating agents when the vanadium level on the catalyst increases to 7800 ppmw or above. The 17.4 volume percent conversion obtained in run 12 is exactly the same as that for the vanadium deactivated catalyst used in run 10. Likewise, run 13 resulted in only a small increase in volume percent conversion, 17.5 to 21.5. As shown by runs 14 through 16 in Table 3, lanthanum, ytterbium and holmium are not effective passivating agents at vanadium loadings of about 7800 ppmw. This is expected since runs 7, 8, and 9 in Table 2 show that these rare earths are not effective passivating agents at lower vanadium loadings.

EXAMPLE 3

The procedure of Example 1 is again followed except the commercial catalyst utilized is Super DX, a high gasoline producing cracking catalyst sold by Davison Chemical Company, the chemical formulation of which is set forth in Table 1. Also, the only rare earth additives tested were cerium, praseodymium, neodymium and ytterbium. The results of this series of tests are set forth in Table 4 below.

TABLE 4

| Run No. | Rare Earth Additive | Rare Earth[a] Additive Loading (wt. %) | Total[b] Rare Earth Loading (wt. %) | Vanadium[c] Loading (ppmw) | Conversion (Vol %) | Gasoline (Vol %) |
|---|---|---|---|---|---|---|
| 17 | None added | — | 2.96 | — | 81.9 | 65.5 |
| 18 | None added | — | 2.96 | 5400 | 12.7 | 9.0 |
| 19 | Cerium | 1.85 | 3.97 | 5400 | 50.1 | 42.9 |
| 20 | Praseodymium | 1.37 | 4.13 | 5600 | 36.1 | 29.0 |
| 21 | Neodymium | 2.47 | 4.83 | 5300 | 53.9 | 42.9 |
| 22 | Ytterbium | 2.91 | 5.87 | 5500 | 16.2 | 11.1 |
| 23 | Lanthanum | 2.29 | 5.25 | 5400 | 17.0 | 10.3 |

[a]Represents the sum, calculated based on the oxide, of the amount of the particular rare earth additive and the amount of any of that same rare earth already present in the catalyst.
[b]Represents the sum of the amounts of all rare earths present in the catalyst calculated based on the respective oxides of the rare earths.
[c]Concentration in ppmw based on vanadium metal.

The data in Table 4 indicate that the effect of vanadium poisoning on Super DX catalyst is greater than that on Sigma 400 catalyst. According to runs 17 and 18 in Table 4, the volume percent conversion decreased from 81.9 percent to 12.7 percent when the vanadium loading increased from 0 to 5400 ppmw. Since Sigma 400 is commercially sold as a good metals tolerant catalyst, it is expected that it should not deactivate as rapidly as Super DX catalyst. This fact is confirmed by the data for runs 1 and 2 in Table 2. Runs 19 through 21 in Table 4 demonstrate that cerium, praseodymium, and neodymium are effective passivating agents for vanadium loaded Super DX catalyst with cerium and neodymium being most effective as indicated by about a four-fold increase in volume percent conversion over that obtained in run 18 with the vanadium deactivated catalyst. The use of praseodymium in run 20 resulted in increasing the volume percent conversion only about 2.8 times that obtained in run 18 with the vanadium deactivated catalyst. The praseodymium, however, was present in smaller quantities as compared to the cerium and neodymium in runs 19 and 21. The data for runs 22 and 23 indicate that ytterbium and lanthanum are not effective passivating agents for Super DX catalyst. Similar results were seen with respect to Sigma 400 catalyst in runs 7 and 8 in Table 2 and runs 14 and 15 in Table 3.

It will be apparent from the foregoing that the invention provides a process for the catalytic cracking of vanadium contaminated feedstocks such that the cracking catalyst retains a relatively high activity as the vanadium concentration of the catalyst increases during the cracking operation. The vanadium tolerance of the catalyst results in longer run times between catalyst changeovers and the need for less make up catalyst. These factors in turn result in lower cost operations.

Although this invention has been primarily described in conjunction with examples and by reference to embodiments thereof, it is evident that many alternatives, modifications and variations will be apparent to those skilled in the art in light of the foregoing description. Accordingly, it is intended to embrace within the invention all such alternatives, modifications and variations that fall within the spirit and scope of the appended claims.

I claim:

1. A process for the catalytic cracking of a vanadium-containing hydrocarbon feedstock which process comprises contacting said hydrocarbon feedstock with a cracking catalyst under cracking conditions in the substantial absence of added molecular hydrogen in a cracking zone to convert components of said feedstock into lower molecular weight constituents, said cracking catalyst comprising:

(a) a crystalline aluminosilicate zeolite dispersed in a matrix; and (b) a vanadium passivating agent selected from the group consisting of cerium and neodymium and compounds thereof, said passivating agent being present in said catalyst in an amount greater than about 1.0 weight percent, calculated as the oxide of said vanadium passivating agent and based on the carbon-free weight of said catalyst, and in an amount such that the weight ratio of said passivating agent to any lanthanum present in said catalyst, calculated based on the respective oxides, is greater than about 1.0, and wherein the total weight of all rare earths present in said catalyst is greater than about 2.0 weight percent, calculated based on the respective rare earth oxides and on the carbon-free weight of said catalyst, and wherein after said vanadium passivating agent is added to the dispersion of said crystalline aluminosilicate zeolite in said matrix to form said catalyst there is no subsequent treatment of said catalyst to induce precipitation of said passivating agent.

2. A process as defined by claim 1 wherein said hydrocarbon feedstock has a vanadium concentration greater than about 1.0 ppmw, calculated as the metal.

3. A process as defined by claim 2 wherein said hydrocarbon feedstock has a vanadium concentration greater than about 5.0 ppmw, calculated as the metal.

4. A process as defined by claim 1 wherein greater than about 50 weight percent of said vanadium passivating agent, calculated as the oxide, is present in said matrix.

5. A process as defined by claim 1 wherein said vanadium passivating agent comprises a cerium component.

6. A process as defined by claim 5 wherein said catalyst contains between about 1000 and about 10,000 ppmw vanadium, calculated as the metal and based upon the carbon-free weight of said catalyst.

7. A process as defined by claim 6 wherein said crystalline aluminosilicate zeolite comprises a Y zeolite.

8. A process as defined by claim 7 wherein said matrix comprises a porous, inorganic refractory oxide component.

9. A process for the catalytic cracking of a vanadium-containing hydrocarbon feedstock which process comprises contacting said hydrocarbon feedstock with a cracking catalyst under cracking conditions in the substantial absence of added molecular hydrogen in a cracking zone to convert components of said feedstock into lower molecular weight constituents wherein said cracking catalyst contains less than about 7800 ppmw vanadium, calculated as the metal and based on the carbon-free weight of said catalyst, and said cracking catalyst comprises:

(a) a crystalline aluminosilicate zeolite dispersed in a matrix; and (b) a vanadium passivating agent comprising gadolinium or compounds thereof, said passivating agent being present in said catalyst in an amount greater than about 1.0 weight percent, calculated as the oxide of said vanadium passivating agent and based on the carbon-free weight of said catalyst, and in an amount such that the weight ratio of said passivating agent to any lanthanum present in said catalyst, calculated based on the respective oxides, is greater than about 1.0, and wherein the total rare earth content of said catalyst is greater than about 2.0 weight percent, calculated based on the respective rare earth oxides and on the carbon-free weight of said catalyst.

10. A process as defined by claim 9 wherein said hydrocarbon feedstock has a vanadium concentration greater than about 5.0 ppmw, calculated as the metal.

11. A process as defined by claim 9 wherein greater than about 50 weight percent of said vanadium passivating agent, calculated as the oxide, is present in said matrix.

12. A process as defined by claim 9 wherein said weight ratio of said passivating agent to any lanthanum present in said catalyst is greater than about 1.5.

13. A process as defined by claim 9 wherein said crystalline aluminosilicate zeolite comprises a Y zeolite.

14. A process as defined by claim 13 wherein said cracking catalyst contains between about 1500 and about 7500 ppmw vanadium, calculated as the metal and based on the carbon-free weight of said catalyst.

15. A process as defined by claim 14 wherein said hydrocarbon feedstock has a vanadium concentration greater than about 1.0 ppmw, calculated as the metal.

16. A process for the catalytic cracking of a vanadium-containing hydrocarbon feedstock which process comprises contacting said hydrocarbon feedstock with a cracking catalyst under cracking conditions in the substantial absence of added molecular hydrogen in a cracking zone whereby vanadium deposits onto said catalyst and components of said feedstock are converted into lower molecular weight constituents, said catalyst comprising:

(a) a crystalline aluminosilicate zeolite dispersed in a matrix; and (b) greater than about 1.0 weight percent cerium, calculated as $CeO_2$ and based on the carbon-free weight of said catalyst, whereby said cerium passivates vanadium which deposits onto said catalyst and wherein a sufficient amount of said cerium is present such that the weight ratio of cerium to any lanthanum, calculated as $CeO_2/La_2O_3$, present in said catalyst is greater than about 2.0 and the total rare earth content of said catalyst is greater than about 2.0 weight percent, calculated based on the respective rare earth oxides and on the carbon-free weight of said catalyst.

17. A process as defined by claim 16 wherein said crystalline aluminosilicate zeolite comprises a Y zeolite.

18. A process as defined by claim 17 wherein greater than about 50 weight percent of said cerium, calculated as $CeO_2$, is present in said matrix.

19. A process as defined by claim 17 wherein said vanadium-containing hydrocarbon feedstock contains greater than 5.0 ppmw vanadium, calculated as the metal.

20. A process as defined by claim 17 wherein the total rare earth content of said catalyst is greater than about 3.0 weight percent, calculated based on the respective rare earth oxides and on the carbon-free weight of said catalyst.

21. A process as defined by claim 17 wherein said catalyst contains between about 1000 and about 10,000 ppmw vanadium, calculated as the metal and based upon the carbon-free weight of said catalyst.

* * * * *